US005090057A

United States Patent [19]

Aldridge

[11] Patent Number: 5,090,057

[45] Date of Patent: Feb. 25, 1992

[54] COMBINED BOOTS/TURNOUT PANT

[75] Inventor: Donald Aldridge, New Carlisle, Ohio

[73] Assignee: Lion Apparel, Inc., Dayton, Ohio

[21] Appl. No.: 565,038

[22] Filed: Aug. 9, 1990

[51] Int. Cl.[5] ..... A41B 7/00

[52] U.S. Cl. ..... 2/82; 2/227; 2/232; 2/270

[58] Field of Search ..... 2/22, 23, 79, 82, 227, 2/231, 232, 233, 270; 36/1.5

[56] References Cited

U.S. PATENT DOCUMENTS

| | | | |
|---|---|---|---|
| 413,149 | 10/1889 | Rexer et al. . | |
| 869,177 | 10/1907 | Hathaway . | |
| 1,896,183 | 2/1933 | Manson | 2/79 |
| 2,596,112 | 5/1952 | Aines . | |
| 2,730,723 | 1/1956 | Jonsson | 2/270 |
| 2,786,208 | 3/1957 | Oberg | 2/270 |
| 2,813,272 | 11/1957 | Hagan | 2/82 |
| 3,312,982 | 4/1967 | Pitman | 2/232 |
| 3,411,160 | 11/1968 | Le Roux et al. . | |
| 3,671,975 | 6/1972 | Vorsteher | 2/232 |
| 3,758,890 | 9/1973 | Selzer | 2/232 |
| 4,064,641 | 12/1977 | Levine | 2/232 |
| 4,543,670 | 10/1985 | Ehring | 2/270 |
| 4,773,100 | 9/1988 | Kuo | 2/46 |
| 4,817,211 | 4/1989 | Grillot et al. | 2/227 |
| 4,858,342 | 8/1989 | Nicholson et al. | 36/109 |
| 4,864,742 | 9/1989 | Grillot et al. | 36/109 |
| 4,879,679 | 11/1989 | Grilliot et al. | 2/312 |

FOREIGN PATENT DOCUMENTS

| | | | |
|---|---|---|---|
| 451003 | 9/1948 | Canada | 2/82 |
| 2606604 | 5/1988 | France | 2/23 |
| 487038 | 11/1953 | Italy | 2/227 |
| 970698 | 9/1964 | United Kingdom | 2/233 A |
| 2132072 | 7/1984 | United Kingdom | 2/231 |

OTHER PUBLICATIONS

*Project Fires* final report by Abeles et al. of the Grumman Aerospace Corp., Dec. 1978.

*Primary Examiner*—Werner H. Schroeder
*Assistant Examiner*—Diana L. Biefeld
*Attorney, Agent, or Firm*—Killworth, Gottman, Hagan & Schaeff

[57] ABSTRACT

A combined turnout pant and boot provide an effectively continuous moisture barrier. Each pant leg includes a moisture barrier liner and may include a first cuff. To fasten the boot to the liner, a second cuff, which may be attached to the top of the boot, is pulled up to the bottom of the moisture barrier liner and first and second corrugated connections are sealed together. The corrugated connections may be at one end of the second cuff and at the bottom of the first cuff; at the other end of the second cuff, with the second cuff being an extension of the liner and the first cuff, and at the top of the boot, or at both ends of the second cuff and at the first cuff and at the top of the boot. Excess material on the second cuff permits the second cuff to fold down, tending to fall over the boot with the liner extending down over the boot with it, thereby providing a substantially complete moisture barrier betwene the pant and the boots.

20 Claims, 4 Drawing Sheets

COMBINED BOOTS/TURNOUT PANT

BACKGROUND OF THE INVENTION

The present invention relates generally to protective clothing for firefighters and, more particularly, to a combination boot and turnout pant wherein the pant legs are removably secured to a pair of boots to provide a substantially watertight seal yet permit the boots to be readily removed from the pant.

Firefighting is very physically demanding work which must be performed under stressful conditions even in the best of circumstances. It is essential for firefighters to wear clothing which protects them from the hazards of the fire environment, while still providing comfort and preventing unnecessary distraction from their work. Firefighter apparel most often consists of a longsleeved turnout coat, protective gloves, full length turnout pant, and boots. When firefighters respond to a call, they normally pull on turnout pant and then put on boots which extend up into the pant. Alternatively, the pant legs may be provided with large enough openings such that booted feet can pass through the pant legs.

Ideally, it would be better to have the boots secured to the pant such that firefighters can simply slip off their current footwear and climb into the turnout pant and attached boots. However, there are problems associated with permanently attaching the boots to the pant. These problems include, cleaning the boots and pant on a periodic basis and the effective destruction of the pant whenever a boot is damaged or vice versa.

Although the pant and boots of prior art turnout apparel provide excellent protection when firefighters are standing upright on a dry surface, many duties of a firefighter require stepping or kneeling in standing water. These duties invariably result in water entering one or both boots and/or the pant thermal layer. Besides being uncomfortable, a wet pant thermal layer or boot full of water is an unnecessary distraction which prevents firefighters from fully concentrating on their work. Even the moisture barrier of prior art turnout pant cannot prevent water from inching up the thermal layer once it becomes wet. A wet thermal layer takes a long time to dry and, more importantly, has lower thermal protection for the firefighter than a dry thermal layer.

U.S. Pat. No. 4,879,769 discloses a vertically extending strap and fastener attachment means for attaching firefighters trousers to their boots to prevent the trouser cuffs from riding up and lodging at the upper edge of the boots. However, the strap and fastener attachment of this patent does not provide a moisture proof barrier which will keep the inside layers of the trousers and/or the boots dry when a firefighter is wading or crawling through water.

Accordingly, there is a need for an improved combination turnout pant and associated boots which provide a substantially watertight seal between the pant and the boots to substantially reduce the intrusion of water into the boots and into a pant thermal layer, yet permit removal of the boots from the pant for periodic cleaning and for replacement or repair of a damaged boot or pant, thereby providing advances in the art and, more importantly, better protection for firefighters.

SUMMARY OF THE INVENTION

The improvements of the present invention solve the problems existing in prior art turnout apparel by providing a combination turnout pant and boot which has an effectively continuous moisture barrier connecting the pant and boots. In the present invention, a pant thermal layer is protected from moisture by an intermediate moisture barrier liner which is connected to the upper part of a firefighter's boots by means of a corrugated connecting means, a first portion of which is attached to a first cuff located at the bottom of the pant leg as a part of the moisture barrier liner, and a second portion of which is attached to a second cuff located at the top of the boot. The first and second cuffs preferably extend entirely around the perimeter of the pant leg and the boot, respectively.

Corrugations on the first portion snugly engage corrugations on the second portion to provide substantially complete moisture resistance at the connection between the pant and the boot. The second cuff preferably contains excess material to allow the firefighter to stretch, bend and crouch without danger of disconnecting the first and second portions of the connecting means. To fasten the boot to the pant liner, the boot cuff is pulled up and secured to the pant cuff at the bottom of the moisture barrier liner to secure the two portions of the connecting means together. The boot cuff then tends to fold down under the influence of the weight of the moisture barrier liner such that the connected boot cuff and moisture barrier liner drape over the boot to provide a contiguous and effective moisture seal between the boot and the pant, while still permitting ready separation for cleaning or replacement.

In accordance with the present invention, firefighter turnout apparel comprises: a lower body portion including full length pant legs, the pant legs having a liner and further having a first cuff; a foot portion including a pair of firefighters boots, the boots having top openings and further having second cuffs, the second cuff of each boot having a top portion and a bottom portion; and connecting means for connecting the first cuffs of the pant to the second cuffs of the boots.

In a preferred embodiment of the present invention, the first cuffs extend around a perimeter of the moisture barrier liner of the pant legs. Also, the second cuffs, which are preferably rubber, are tapered such that the top portion has a circumference equivalent to a circumference of the pant legs, and the bottom portion has a circumference equivalent to a circumference of the openings of the boots. The excess material permits the boot cuff and pant to drape down over the boot, and allows the firefighter to stretch and bend without disengaging the first portion of the connecting means from the second portion of the connecting means. Finally, the connecting means are preferably moisture resistant to provide an effective moisture barrier between the pant and the boot.

In a further embodiment of the present invention, the first portion of the connecting means are bonded to the first cuff and the second portion of the connecting means are bonded to the second cuff. The first and second portions of the connecting means comprise corrugations such that the corrugations of the first portion of the connecting means snugly engage the corrugations of the second portion of the connecting means.

In another embodiment of the present invention, the second cuff is an extension of the first cuff and the liner and the second cuff is attached to the boot via the connecting means. Finally, in yet another embodiment of the invention the second cuff is detachably attached the first cuff and to the boot via a pair of connecting means.

It is an object of the present invention to provide improved firefighter turnout apparel to better protect firefighters; to provide a combination firefighter turnout pant and boots which substantially prevent moisture from reaching the thermal layer of the pant at the connections between the pant and the boots; to provide such turnout apparel which includes a thermal layer and a moisture barrier liner as part of the pant; and, to provide such turnout apparel wherein the moisture barrier liner is attachable to the boots to provide substantial moisture resistance.

Other objects and advantages of the invention will be apparent from the following description, the accompanying drawings, and the appended claims.

DETAILED DESCRIPTION OF THE INVENTION

The present invention provides a combination turnout pant and boot in which a moisture barrier liner of the pant is secured to a firefighter's boot. Each pant leg includes a moisture barrier liner and may include a first cuff. To fasten the boot to the liner, a second cuff, which may be attached to the top of the boot, is pulled up to the bottom of the moisture barrier liner and first and second corrugated connections of a connecting means are sealed together. The corrugated connections may be at one end of the second cuff and at the bottom of the first cuff; at the other end of the second cuff, with the second cuff being an extension of the liner and the first cuff, and at the top of the boot, or at both ends of the second cuff and at the first cuff and at the top of the boot. Excess material on the second cuff permits the second cuff to fold down, tending to fall over the boot with the liner extending down over the boot with it, thereby providing a substantially complete moisture barrier between the pant and the boots. The connecting means is corrugated such that the corrugations of the first portion snugly fit within the corrugations of the second portion. In this way, the boots are secured to the turnout pant to provide a contiguous and effective moisture seal between the boots and the turnout pant, yet ready separation is still permitted for cleaning or in the event of damage.

Figure 1A:
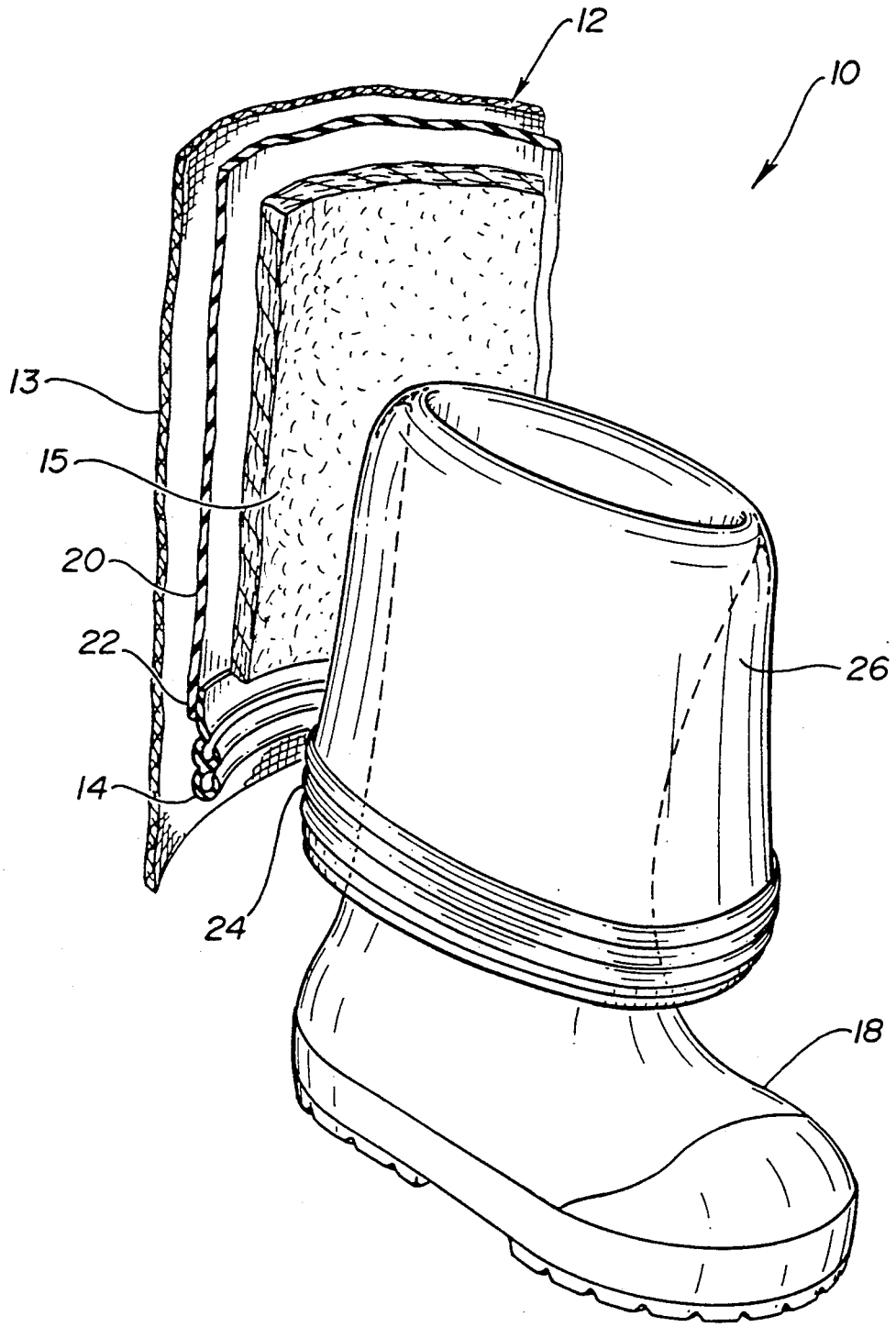
FIGS. 1A and 1B are partial cut away side views illustrating the combined turnout pant and boot of the present invention, including connecting means between the pant and the boot for providing moisture resistance.
Figure 1B:
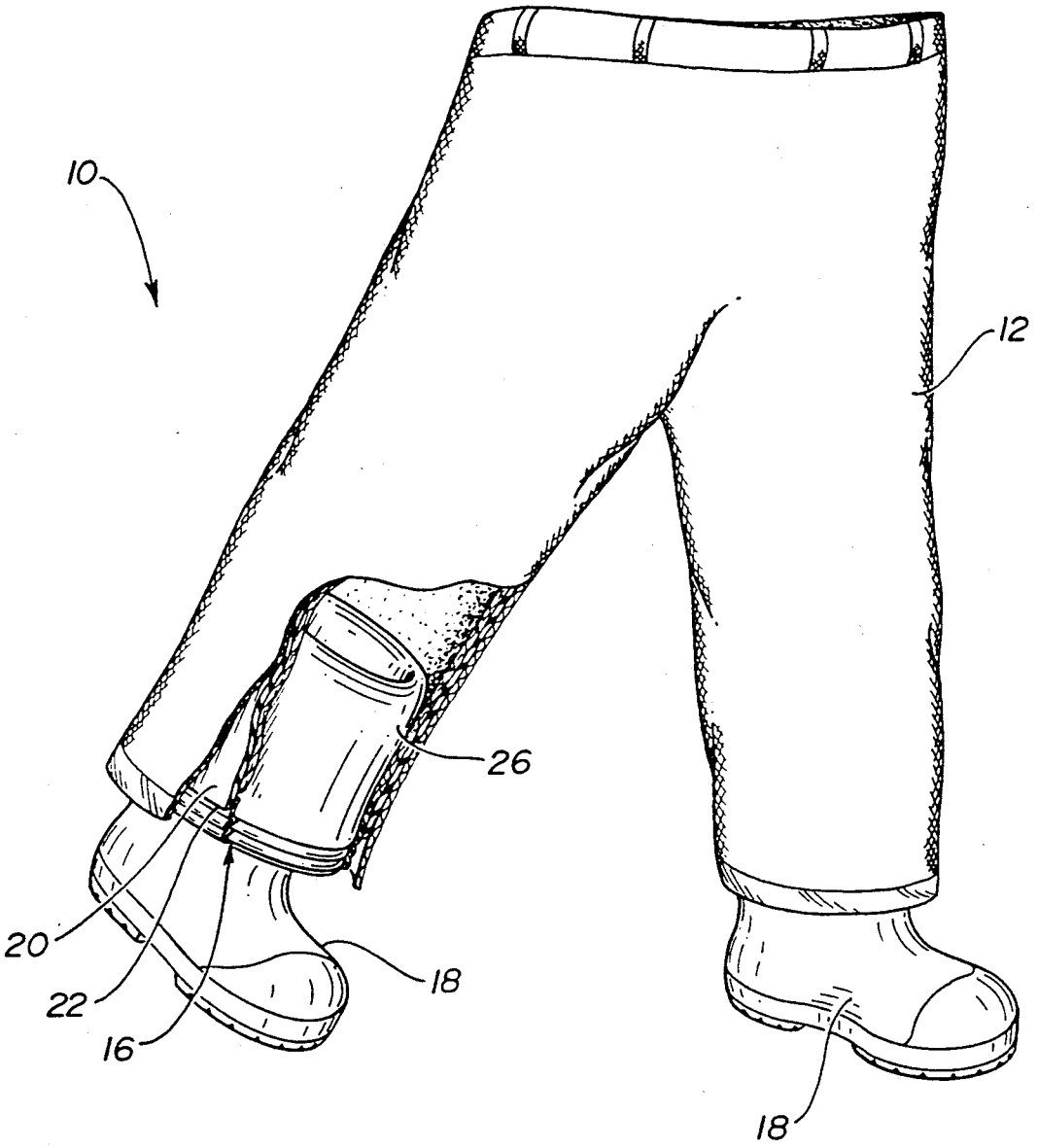

Referring now to the drawings, and particularly to FIGS. 1A and 1B, a preferred embodiment of a combination firefighter turnout pant and boots is shown, generally designated as reference number 10. The turnout pant 12 is shown partially cut away to illustrate the layers of the pant 12, including an outer layer 13, an inner thermal layer 15, and an intermediate moisture barrier liner 20. A first portion 14, best illustrated in FIG. 2, of a connecting means 16, secures the pant 12 to a firefighter's boot 18 to provide moisture resistance. In the preferred embodiment shown in FIGS. 1A and 1B, the moisture barrier liner 20, typically situated as an intermediate layer between the outer layer 13 and the inner thermal layer 15, of the turnout pant 12, has an inner perimeter and an outer perimeter and may be secured to the boot 18 by any suitable connecting means, such as connecting means 16.

Figure 3C:
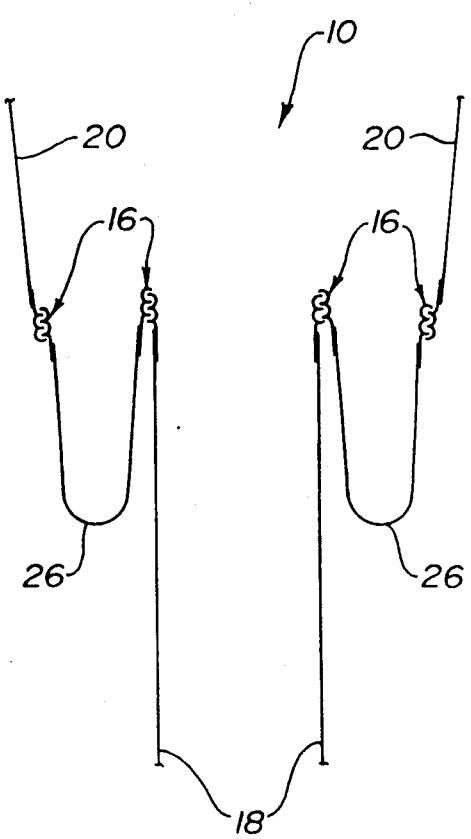
FIGS. 3A, 3B, and 3C illustrate schematic sectional views of one leg of the combination firefighter turnout pant and boots of the present invention, illustrating the mobility of the boot cuff.
Figure 3B:
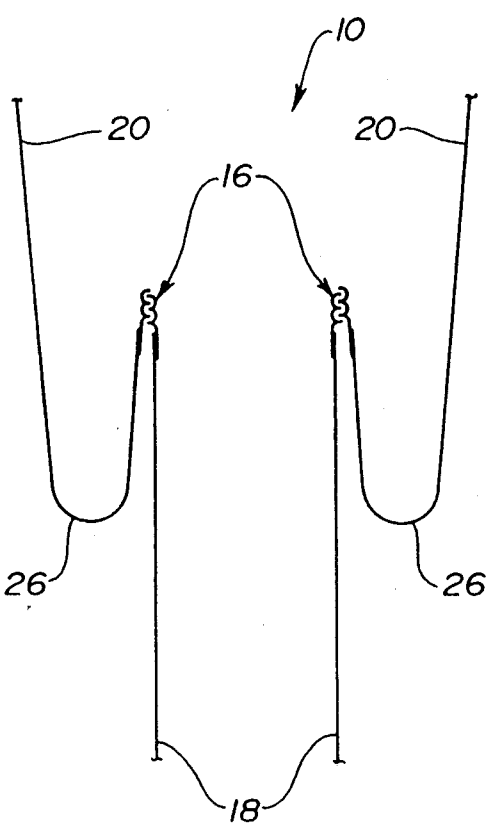
Figure 3A:
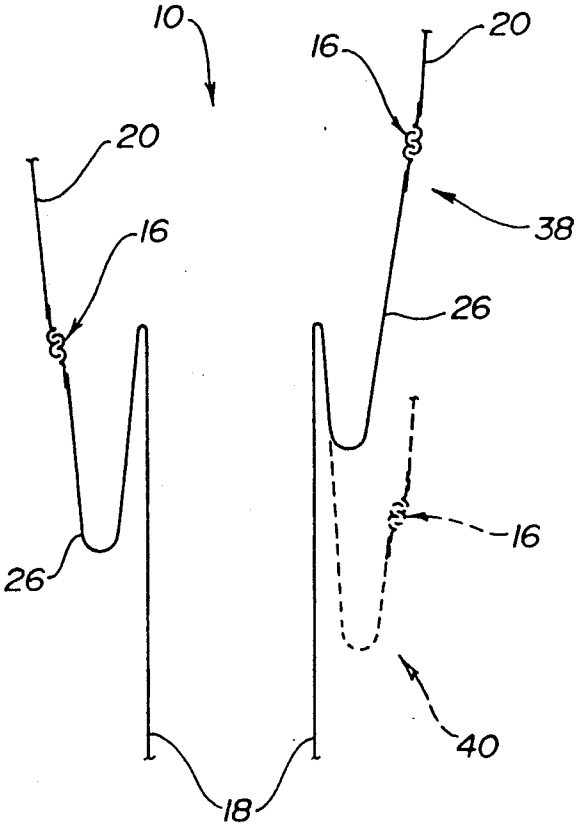

In one embodiment of the present invention, the first portion 14 of the connecting means 16 is located on a first cuff 22 attached at the bottom of the moisture barrier liner 20 and extending around the inner perimeter of the moisture barrier liner 20, and a second portion 24 is located on a second cuff 26 of the boot 18, located at the top of the boot 18 and extending around the perimeter of the boot 18 and being at least 6 inches wide and typically 6–8 inches wide. The first cuff 22 may be quite wide or it may merely be the bottom edge of the perimeter of the pant 12. It will be obvious to persons of ordinary skill in the art that a number of modifications and variations of the cuffs and connecting means are possible, some of which are illustrated in FIGS. 3A, 3B, and 3C. For example, alternate connecting means could be used where it was desired to join the pant to the boots with a less effective moisture seal. In similar applications, only portions of the cuff may be provided such that the pant and boots are interconnected but a continuous moisture barrier is not provided. Alternatively, the loose, tapered cuff 26 could be permanently attached at the bottom of the pant cuff 22 and sealingly connected to the boot with connecting means 16. Yet another alternative is to make the second cuff 26 detachable from both the pant and the boot.

Figure 2:
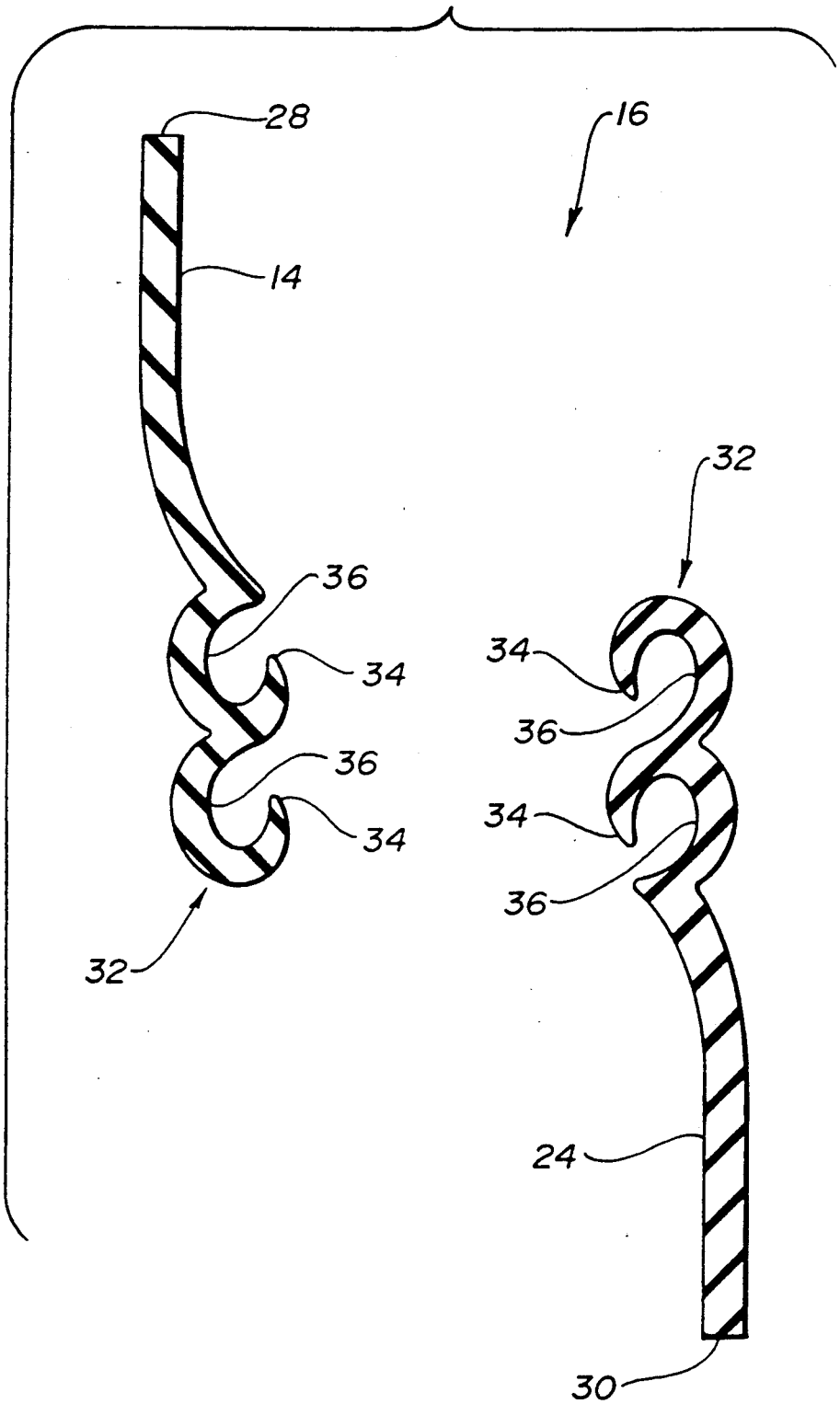
FIG. 2 illustrates the first portion and the second portion of the connecting means of the present invention.

Referring now to FIG. 2 and continuing with FIGS. 1A and 1B, in one embodiment of the present invention, the connecting means 16 includes a first portion 14 attached by means of a top end 28 to the first cuff 22 of the pant 12, sealingly connected or formed into the moisture barrier liner 20, and a second portion 24 attached by means of a bottom end 30 to a second cuff 26 of the boot 18. The second cuff 26 is preferably constructed of a flexible and moisture resistant material, such as rubber, to permit mobility of the firefighter without creating stress at the connecting means 16 between the pant 12 and the boot 18, and the second portion 24 of the connecting means 16 is sealingly connected to the second cuff 26 or formed therein. In addition, the connecting means 16 is preferably constructed of a highly waterproof material to maximize the moisture resistance of the connection means.

A connecting end 32 of the first and second portions 14 and 24 are preferably corrugated such that the protrusions 34 of the first portion 14 fit snugly within the indentations 36 of the second portion 24. Likewise, the protrusions 34 of the second portion 24 may be snugly secured within the indentations 36 of the first portion 14 to provide substantially complete moisture resistance between the pant 12 and the boot 18. The protrusions 34 are gripped between the indentations 36 to fill the indentations 36 of the connecting means 16. This construction allows the protrusions 34 of the preferably corrugated connection means 16 to securely interlock with the indentations 36 to create substantially complete moisture resistance at the interconnection of the pant 12 and the boot 18. Hence, the connecting means 16 provides a continuous moisture barrier to substantially prevent water from seeping into a firefighter's pant or boot. Also, constructing the second cuff 26 such that it contains excess material allows the firefighter to stretch, bend and crouch without danger of disconnecting the first and second portions 14, 24 of the connecting means 16, as best illustrated in FIG. 3A. Alternatively, the first cuff 22 could contain the excess material and be attachable to the boot 18 via connecting means 16.

Referring now to FIG. 3A, the mobility or flexibility of the second cuff 26 is illustrated. To fasten the boot 18 to the pant liner cuff 22, the boot cuff 26 is pulled up and secured to the pant cuff 22 at the bottom of the liner 20 to secure the two portions 14 and 24 of the connecting means together. The boot cuff or second cuff 26 then tends to fold down with the moisture barrier liner 20 attached thereto such that the boot or second cuff 26 and liner 20 drape over the boot 18 to provide a contiguous and effective moisture seal between the boot 18 and the pant 12. The second cuff 26 is preferably tapered from the bottom portion to the top portion of the cuff 22 such that said bottom portion has a circumference equivalent to the circumference of the pant legs and the top portion has a circumference equivalent to the circumference of the opening at the top of the boot 18.

In FIG. 3A, reference number 38 refers to the amount of drape which would typically occur when the firefighter is in a crouched position. In such a position, the pant leg moisture barrier liner 20 would tend to ride up, thereby pulling the connecting means 16 upward. The stress created at the connecting means 16 is alleviated by providing excess material in the second cuff 26 to permit the cuff second 26 to ride up as the pant leg rides up. Similarly, reference number 40 refers to the amount of drape which is typical when the firefighter is in a standing position. In such a position, the pant leg and, therefore, the moisture barrier liner 20 will be extended down, almost to the foot of the boot 18. The excess material in the boot or second cuff 26 permits the connecting means 16 to extend downward with the pant leg, as illustrated in FIG. 1A, instead of pulling the pant leg up toward the top of the boot. Consequently, the invention provides substantially complete moisture resistance between the pant and the boots, yet permits flexibility for the firefighter without stressing or disconnecting the pant from the boots while the firefighter is working.

It will be obvious to persons of ordinary skill in the art that the moisture resistance can still be provided with modifications and variations in the cuff and connecting means. For instance, FIG. 3B illustrates cuff 26 permanently attached to the pant 12, instead of attached to the boot 18 as in FIG. 3A. In this embodiment, the first cuff 22 is only a minimal amount of material located at the bottom of the liner 20 and extending around the perimeter of the pant 12 with the second cuff 26 attached thereto. Alternately, the first cuff 22 can be extended to define the second cuff 26. In addition, the connecting means 16 are provided around the perimeter of the top of the boot 18, such that the cuff 26 is detachable from the boot 18. Alternatively, FIG. 3C illustrates an embodiment wherein the second cuff 26 is detachable from both the boot 18 and the pant 12, at a pair of connecting means 16. In yet another embodiment, alternate connecting means could be used where it is desired to join the pant to the boots with a less effective moisture seal. In similar applications, only portions of the second cuff 26 may be provided such that the pant and boots are interconnected, but a continuous moisture barrier is not provided.

Having described the invention in detail and by reference to preferred embodiments thereof, it will be apparent that modifications and variations are possible without departing from the scope of the invention which is defined in the appended claims.

What is claimed is:

1. Firefighter turnout apparel comprising:

a lower body portion including full length pant legs, each of said pant legs having a liner terminating in a first cuff;

a foot portion including a pair of firefighter boots, said boots each having a top opening;

a second cuff for each of said legs, said second cuffs each having a top portion and a bottom portion; and connecting means for continuously connecting said first cuffs and said second cuffs to said liner and said boots whereby a substantially continuous moisture barrier is formed from said boots to said liner.

2. Firefighter turnout apparel as claimed in claim 1 wherein said first cuffs extend around perimeters of said liner pant legs.

3. Firefighter turnout apparel as claimed in claim 1 wherein each of said second cuffs is rubber.

4. Firefighter turnout apparel as claimed in claim 1 wherein each of said second cuffs is at least 6 inches wide.

5. Firefighter turnout apparel as claimed in claim 1 wherein each of said second cuffs is tapered from said top portion to said bottom portion such that said top portion has a circumference equivalent to a circumference of one of said pant legs and said bottom portion has a circumference equivalent to a circumference of said opening of one of said boots.

6. Firefighter turnout apparel as claimed in claim 1 wherein each of said second cuffs includes excess material.

7. Firefighter turnout apparel as claimed in claim 6 wherein said second cuffs are permanently secured to said boots and said excess material drapes over said boots.

8. Firefighter turnout apparel as claimed in claim 1 wherein said second cuffs are permanently secured to said pant legs and detachably secured to said boots.

9. Firefighter turnout apparel as claimed in claim 1 wherein said second cuffs are detachably secured to said pant legs and detachably secured to said boots.

10. Firefighter turnout apparel as claimed in claim 1 wherein said connecting means are moisture resistant.

11. Firefighter turnout apparel as claimed in claim 1 wherein said connecting means comprise first portions and second portions.

12. Firefighter turnout apparel as claimed in claim 11 wherein said first portions of said connecting means are bonded to said first cuffs.

13. Firefighter turnout apparel as claimed in claim 11 wherein said second portions of said connecting means are bonded to said second cuffs.

14. Firefighter turnout apparel as claimed in claim 11 wherein said first and second portions of said connecting means comprise corrugations such that said corrugations of said first portions of said connecting means snugly engage said corrugations of said second portions of said connecting means.

15. Firefighter turnout apparel as claimed in claim 11 wherein said first portions of said connecting means are bonded to said second cuffs, said second cuffs being permanently attached to said first cuffs, and said second portions of said connecting means are bonded at said top opening of said boots.

16. Firefighter turnout apparel as claimed in claim 15 wherein said first and second portions of said connecting means comprise corrugations such that said corrugations of said first portions of said connecting means snugly engage said corrugations of said second portions of said connecting means.

17. Firefighter turnout apparel comprising:

a lower body portion including full length pant legs each having a liner terminating in a first cuff;

a foot portion including a pair of firefighter boots each of said boots having a top opening;

a second cuff for each of said legs; and a pair of connecting means for each of said legs, a first one of each of said pair of connecting means for continuously connecting corresponding second and first cuffs to one another, and a second one of each of said pair of connecting means for continuously connecting corresponding second cuffs and boot openings to one another.

18. Firefighter turnout apparel as claimed in claim 17 wherein each of said second cuffs have top and bottom portions and, each of said pair of connecting means comprises a first portion and a second portion.

19. Firefighter turnout apparel as claimed in claim 18 wherein said first portion of a first of said pair of connecting means for each leg is bonded to a bottom portion of said second cuff for that leg and said second portion of said first of said pair of connecting means for that leg is bonded at said top opening of said boot for that leg, and said first portion of a second of said pair of connecting means for each leg is bonded to a top portion of said second cuff for that leg and said second portion of said second of said pair of connecting means is bonded to said first cuff for that leg.

20. Firefighter turnout apparel as claimed in claim 19 wherein each of said first and second portions of each of said pair of connecting means comprises corrugations such that said corrugations of each of said first portions of each of said pair of connecting means snugly engage said corrugations of each of said second portions of each of said pair of connecting means.

* * * * *